US007128162B2

(12) United States Patent
Quinn

(10) Patent No.: US 7,128,162 B2
(45) Date of Patent: Oct. 31, 2006

(54) METHOD AND APPARATUS FOR POSITIONING A SLEEVE DOWN HOLE IN A HYDROCARBON PRODUCING WELL AND PIPELINES

(76) Inventor: Desmond Quinn, P.O. Box 23120, Grand Prairie (CA) T8V 6X2

( * ) Notice: Subject to any disclaimer, the term of this patent is extended or adjusted under 35 U.S.C. 154(b) by 237 days.

(21) Appl. No.: 10/811,419

(22) Filed: Mar. 26, 2004

(65) Prior Publication Data

US 2006/0162925 A1 Jul. 27, 2006

(51) Int. Cl.
*E21B 23/04* (2006.01)
*E21B 33/124* (2006.01)
*E21B 43/263* (2006.01)

(52) U.S. Cl. ..... 166/380; 166/383; 166/387; 166/299; 166/63; 166/277; 166/207

(58) Field of Classification Search ..... 166/380, 166/383, 387, 191, 206–208, 212, 299, 63, 166/72, 277
See application file for complete search history.

(56) References Cited

U.S. PATENT DOCUMENTS 2,812,025 A * 11/1957 Doherty et al. ..... 166/207
3,167,122 A * 1/1965 Lang ..... 166/277
3,175,618 A * 3/1965 Lang et al. ..... 166/63
4,069,573 A 1/1978 Rogers, Jr. et al.
RE30,802 E 11/1981 Rogers, Jr.
4,577,696 A * 3/1986 Suman ..... 166/387
4,713,870 A 12/1987 Szalvay
4,793,382 A 12/1988 Szalvay
5,400,827 A 3/1995 Baro et al.
5,787,933 A 8/1998 Russ et al.
5,794,663 A 8/1998 Kiest, Jr. et al.
5,800,522 A 9/1998 Campbell et al.
5,829,524 A 11/1998 Flanders et al.
6,105,619 A 8/2000 Kiest, Jr.
6,619,886 B1 9/2003 Harrington
6,964,305 B1 * 11/2005 McMahan et al. ..... 166/380
2003/0015246 A1 1/2003 Hardin

OTHER PUBLICATIONS

English Abstract of Soviet Union Patent No. SU 810,936 B, issued Mar. 7, 1981, to Korzhenevs et al.
English Abstract of Soviet Union Patent No. SU 825,868 B, issued Apr. 30, 1981, to Farukshin et al.
English Abstract of Soviet Union Patent No. SU 1,270,290, issued Nov. 15, 1986, to Orazklyche.
English Abstract of Soviet Union Patent No. SU 1,627,663, issue Feb. 15, 1991, to Garifov et al.

* cited by examiner

*Primary Examiner*—Kenneth Thompson
(74) *Attorney, Agent, or Firm*—Christensen O'Connor Johnson Kindness PLLC

(57) ABSTRACT

A method for positioning sleeve down hole in a hydrocarbon producing well. A running assembly with associated sleeve is run down a hydrocarbon producing well until the sleeve is in a desired positioned in a conduit. The sleeve is expanded until it sealingly engages the conduit. Pressure is maintained within the sleeve until the seals of holding the pressure sequentially fail to expand the ends of the sleeve. When a preset pressure threshold is reached, the pressure is relieved. The running assembly is then pulled back through the expanded sleeve to surface. A major advantage of this method is that the expanded sleeve provides sufficient internal clearance that a further sleeve of the same size as the original may, in future, be passed through the expanded sleeve and positioned lower down in the well.

31 Claims, 7 Drawing Sheets

METHOD AND APPARATUS FOR POSITIONING A SLEEVE DOWN HOLE IN A HYDROCARBON PRODUCING WELL AND PIPELINES

FIELD OF THE INVENTION

The present invention relates to positioning sleeves in a hydrocarbon producing well and, in particular, sleeves used to seal perforations to prevent the entry into the well of unwanted fluids and sleeves used to repair pipelines.

BACKGROUND OF THE INVENTION

The systems currently used to seal perforations have a fundamental flaw. They form a restriction in the well. This creates a problem should there later arise a need to seal other perforations further down in the well.

U.S. Pat. No. 4,069,573 (Rogers 1978) (reissued as RE 30,802 in 1981) discloses an invention entitled a "method of securing a sleeve within a tube". This type of sleeve was developed to repair heat exchangers associated with nuclear power generation plants. The sleeves are positioned within the tube, and then expanded outwardly to engage the tube. In accordance with the teachings of the Rogers patent, the sleeves are expanded using hydraulics or by applying a compressive force to an elastomer material.

U.S. Pat. No. 4,793,382 (Szalvay 1988) discloses an assembly for repairing a damaged pipe. The Szalvay reference contains a discussion of the shortcomings of the prior art apparatus used to expand sleeves. Some of such apparatus leave components in the damaged pipe, thereby restricting subsequent fluid flow. Others of such apparatus must be repositioned and then re-expanded at intervals along the sleeve. The Rogers reference is criticized as not being suitable where a leak proof fit is necessary; as is the teaching of the Rogers reference of using the sleeve to expand the damaged pipe. The Szalvay reference addresses these shortcomings by advocating the use of shape memory alloy elements. None of the prior art references address how a sleeve might be installed at a distance of several miles down a hydrocarbon producing well to seal off perforated zones or possibly repair damaged sections of conduit.

SUMMARY OF THE INVENTION

What is required is a method and apparatus for positioning sleeves down hole in a hydrocarbon producing well.

According to one aspect of the present invention there is provided a method for positioning sleeve down hole in a hydrocarbon producing well. A first step involves running a running assembly with associated sleeve down a hydrocarbon producing well until the sleeve is in a desired positioned in a conduit. The running assembly includes a first seal assembly sealing a first end of the sleeve and a second seal assembly sealing a second end of the sleeve. The first seal assembly and the second seal assembly have seals adapted to sequentially fail to expand the first end and the second end of the sleeve and to permit the second seal assembly to exit the second end of the sleeve and release the pressure when a preset threshold is reached. A second step involves expanding the sleeve until the sleeve sealingly engages the conduit. A third step involves maintaining pressure within the sleeve as the seals of the first seal assembly and the second seal assembly sequentially fail to expand the first end and the second end of the sleeve and until the preset threshold is reached, at which threshold pressure the second seal assembly exits the second end of the sleeve to relieve the pressure. A fourth step involves pulling the running assembly back through the expanded sleeve to surface. The expanded sleeve providing sufficient internal clearance that a further sleeve of the same size as the original may, in future, be passed through the expanded sleeve and positioned lower down in the well.

According to another aspect of the present invention there is provided an assembly for positioning a sleeve down hole in a hydrocarbon producing well. A sleeve is provided having an interior surface, an exterior surface, a first end and a second end. The sleeve is made of a material which is capable of expanding radially when pressure is applied to the interior surface. A running tool support rod extends axially through the sleeve. The support rod has a first end, a second end, and an exterior surface. A first seal assembly is positioned at the first end of the sleeve. The first seal assembly has more than one annular seal. Each annular seal engages the exterior surface of the support rod and the interior surface of sleeve. A second seal assembly is positioned at the second end of the sleeve. The second seal assembly has more than one annular seal. Each annular seal engages the exterior surface of the support rod and the interior surface of sleeve. A first centralizer is positioned at the first end of the sleeve and is adapted to centralize the first end of the sleeve. A second centralizer is positioned at the second end of the sleeve and is adapted to centralize the second end of the sleeve. Means are provided for preventing outermost seals of the more than one seals of each of the first seal assembly and the second seal assembly from exiting the sleeve until the sleeve has been fully expanded and a preset pressure threshold has been reached. Means are provided for selectively expanding the sleeve by remote activation from surface.

The method and apparatus, as outlined above and hereinafter further described, represents a significant advance in the art. It seals perforations with negligible restriction, so that it is possible to subsequently pass equipment through and seal perforations lower down in the well.

As will hereinafter be further described, the preferred means for maintaining the outermost seal of the second seal assembly in position until the sleeve is fully expanded is to secure a shear sleeve to the support rod by shear screws. The shear sleeve provides containment to prevent an outermost seal of the second seal assembly from exiting the sleeve and relieving the pressure until the sleeve has been fully expanded. The shear screws are adapted to shear when a preset pressure threshold is reached.

As will hereinafter be further described, the preferred mean for expanding the sleeve is to provide a combustion chamber for the combustion of a gas generating medium. An electric igniter element is provided in the combustion chamber and an electrical conduit extends from surface to facilitate remotely igniting the gas generating medium by sending an electrical current from surface to the electric igniter element. An expansion chamber is provided adjacent to the combustion chamber, to accommodate rapidly expanding gases generated by the combustion of the gas generating medium in the combustion chamber.

Although the sleeve could be expanded using only gases, the combustion of gas generating medium tends to leave a residue. It is, therefore, preferred that a fluid chamber be provided which is filled with liquid. The fluid chamber is in fluid communication with the sleeve, which is also filled with liquid. The fluid chamber has a first end and a second end. A fluid conduit extends axially through the support rod from the second end of the fluid chamber to a feed inlet positioned between the first seal assembly and the second seal assembly. A piston is provided having a first face and a second face. The piston is positioned at the first end of the fluid chamber remote from the sleeve. The piston is axially movable in the fluid chamber when a force acts upon the first face of the piston. The first face of the piston is exposed to rapidly expanding gases in the expansion chamber. The rapidly expanding gases serve as a motive force to move the piston toward the second end of the fluid chamber, thereby exerting a hydraulic force upon liquid to expand the sleeve.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
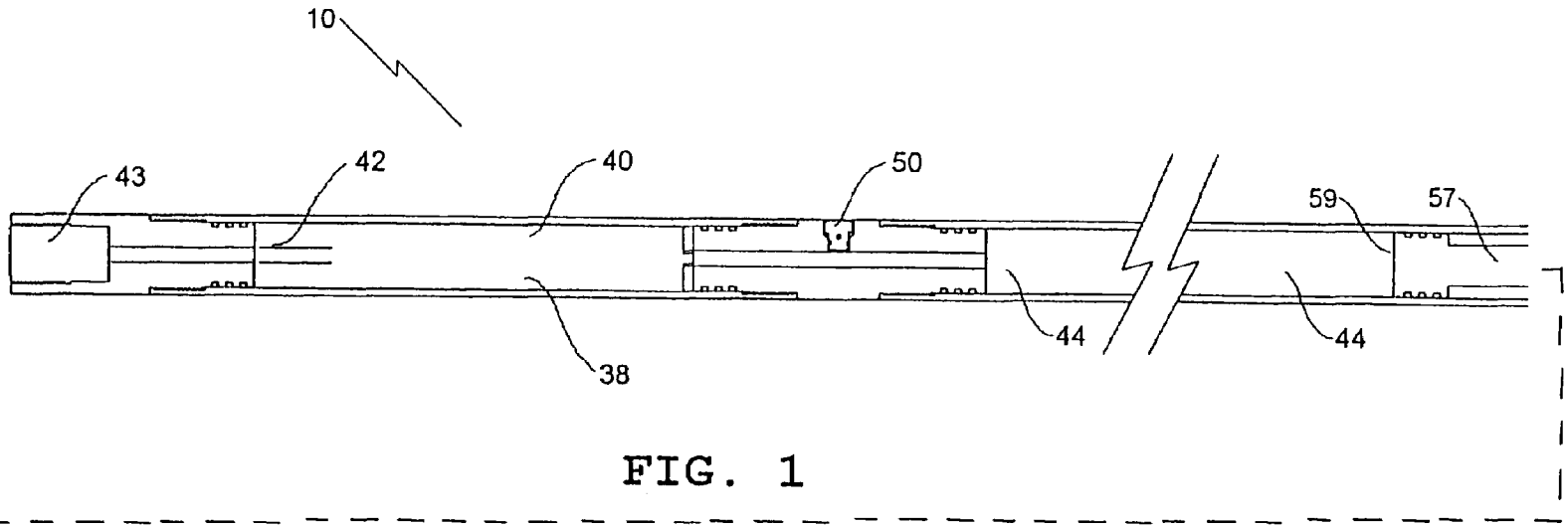
FIG. 1 is a side elevation view, in section of a first section of the assembly for positioning sleeves down hole according to the present invention.

The preferred embodiment, an assembly for positioning sleeves down hole generally identified by reference numeral 10, will now be described with reference to FIGS. 1 through 6.

Figure 2:
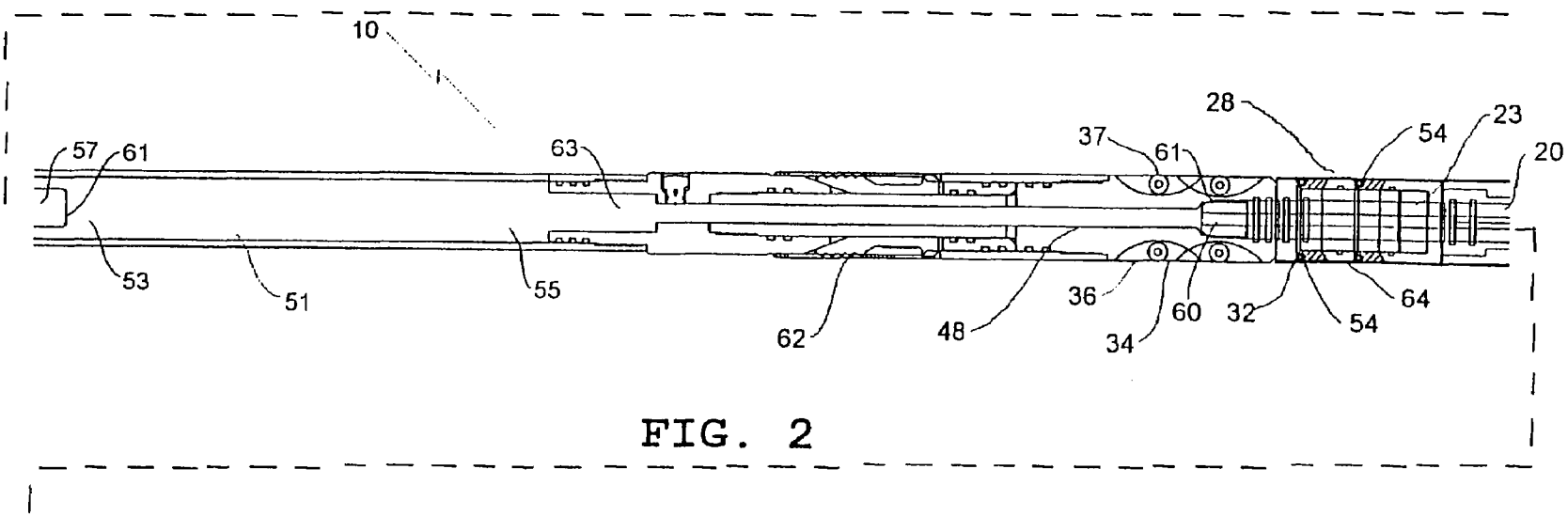
FIG. 2 is a side elevation view, in section, of a second section of the assembly for positioning sleeves down hole according to the present invention, located between the sections depicted in FIG. 1 and FIG. 3.
Figure 3:
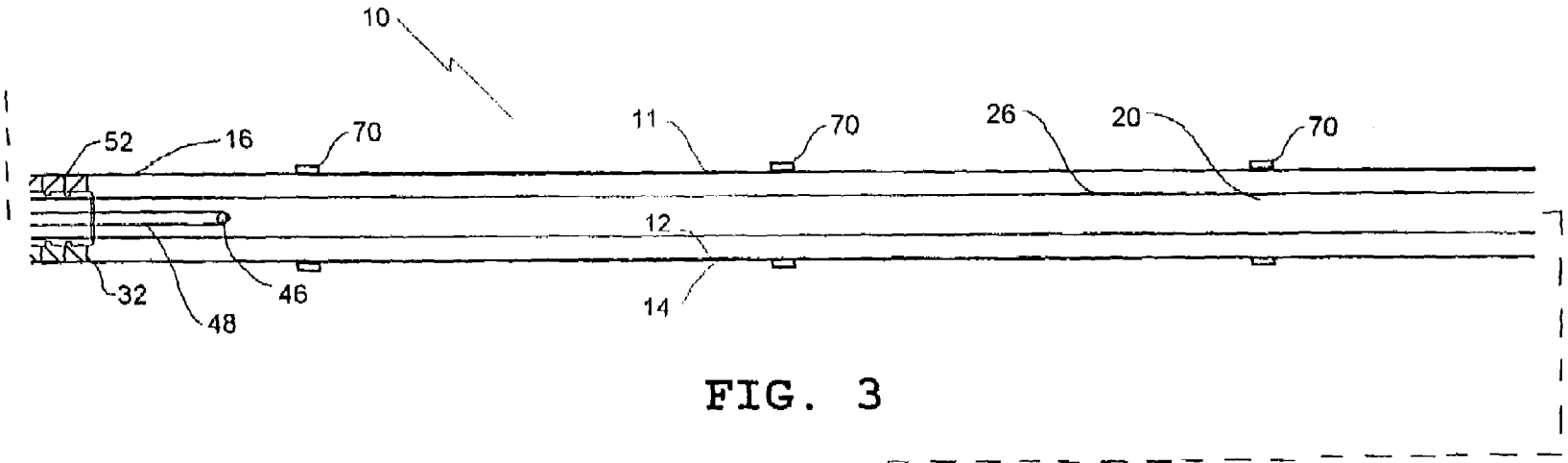
FIG. 3 is a side elevation view, in section of a third section of the assembly for positioning sleeves down hole according to the present invention, located between the sections depicted in FIG. 2 and FIG. 4.
Figure 4:
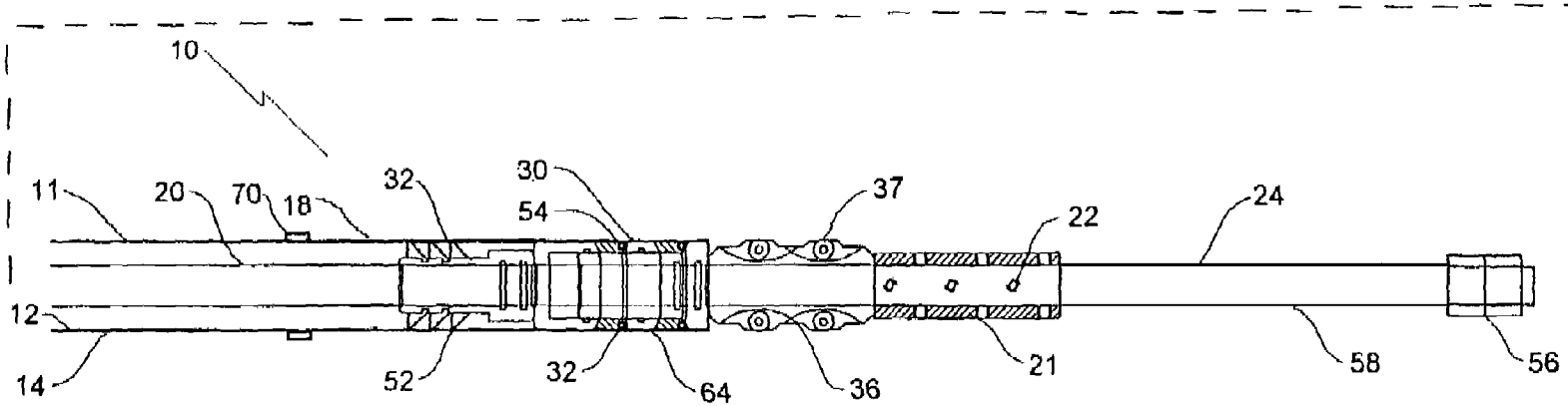
FIG. 4 is a side elevation view, in section of a fourth section of the assembly for positioning sleeves down hole according to the present invention, located adjacent the section depicted in FIG. 3.

Structure and Relationship of Parts:

Referring now to FIG. 1, there is shown the first section of an assembly 10 for positioning a sleeve down hole in a hydrocarbon producing well. Referring to FIG. 3, a third section of the assembly 10, a sleeve 11 has an interior surface 12, an exterior surface 14, a first end 16 and, in FIG. 4, a second end 18. The sleeve 11 is made of a material which is capable of expanding radially when pressure is applied to the interior surface 12. Referring to FIGS. 3 and 4, extending axially through the sleeve 11 is a running tool support rod 20. The support rod 20 has a first end 23, a second end 24, and an exterior surface. Referring to FIG. 2, the upper remote end 60 of the support rod 20 is securely mounted into the assembly via engagement with machine threads 61. Stabilizing slips 62 are provided, the purpose and function of which will hereinafter be further described. In addition, circumferential seals 70 are provided on the exterior surface 14 of the sleeve 11.

There are seal assemblies at each end of the sleeve 11, such that, referring to FIG. 2, there is a first seal assembly 28 positioned at the first end 16 of the sleeve 11, and, referring to FIG. 4, there is a second seal assembly 30 positioned at the second end 18 of the sleeve 11. In FIG. 2, the first seal assembly 28 has more than one annular seal 32, where each annular seal 32 engages the exterior surface 26 of the support rod 20 and the interior surface 12 of sleeve 11. In FIG. 4, the second seal 30 assembly also has more than one annular seal 32, with each annular seal 32 engaging the exterior surface 26 of the support rod 20 and the interior surface 12 of sleeve 11. For a more controlled expansion of the sleeve 11, the seal assemblies 28 and 30 may include at least one inner resilient seal 52 axially spaced from at least one outer high pressure seal 54. The inner seal 52 is such that it will fail before the outer high pressure seal 54. The outer high pressure seals 54 are shown to be carried by seal carrier sleeves 64.

Referring to FIG. 2, a first centralizer 34 positioned at the first end 16 of the sleeve 11, and referring to FIG. 4, a second centralizer 36 is positioned at the second end 18 of the sleeve 11, each adapted to centralize their respective ends of the sleeve 11. The centralizers shown have circumferentially spaced rollers 37. Rollers 37 serve to prevent damage to circumferential seals 70 on exterior surface 14 of sleeve 11, during the descent into the well. Rollers 37 also aid in preventing the assembly from getting stuck or hung up against restrictions in the well either during insertion or withdrawal. This is the case regardless of the deviation angle of the conduit, from vertical. Referring to FIG. 4, there is a shear sleeve 21 secured to the support rod 20 by shear screws 22 to prevent an outermost annular seal 54 of the second seal assembly 30 from exiting the sleeve 11 until the sleeve 11 has been fully expanded. Shear screws 22, are adapted to shear when a preset pressure threshold is reached. Second seal assembly 30 is then able to exit sleeve 11 to release the pressure. The preset pressure threshold is above that required to fully expand the sleeve 11. Below the shear sleeve 21, there is shown a stopper nut 56 positioned on a lower remote end 58 of the support rod 10. Stopper nut prevents shear sleeve 21 from being lost down the well.

Referring to FIG. 1, there is also provided a combustion chamber 38 for the combustion of a gas generating medium 40 such as a slow burning powder that is placed within the combustion chamber 38, as well as an electric igniter element 42 in the combustion chamber 38. An electrical conduit 43 extends from surface 27 to facilitate remotely igniting the gas generating medium 40 by sending an electrical current from surface to the electric igniter element 42. Adjacent to the combustion chamber 38 is an expansion chamber 44 to accommodate rapidly expanding gases generated by the combustion of the gas generating medium 40 in the combustion chamber 38.

Referring to FIG. 2, a fluid chamber 51 is provided which is filled with a liquid, such as a low viscosity hydraulic fluid. Fluid chamber 51 is in fluid communication with sleeve 11, which is filled with the same liquid. Fluid chamber 51 has a first end 53 and a second end 55. A fluid conduit 48 extends axially through support rod 20 from second end 55 of fluid chamber 51 to a feed inlet 46 positioned between first seal assembly 28 and second seal assembly 30 shown in FIG. 3. Referring to FIG. 2, a piston 57 is provided having a first face 59 and, in FIG. 3, a second face 61. Piston 57 is initially positioned at first end 53 of fluid chamber 51 remote from first seal assembly 28 of sleeve 11. However, piston 57 is axially movable in fluid chamber 51 when a force acts upon first face 59. First face 59 of piston 57 is exposed to rapidly expanding gases from expansion chamber 44. The rapidly expanding gases serve as a motive force to move piston 57 from its initial position at first end 53 toward second end 55 of fluid chamber 51. This exerts a hydraulic force upon liquid, which is transmitted through fluid conduit 48 and feed inlet 46 to expand sleeve 11. It will be appreciated that the force of the expanding gases is capable of propelling piston 57 with great force. A restriction 63 is, therefore, provided at second end 55 of fluid chamber 51. As piston 57 approaches second end 55, it encounters restriction 63. The movement of piston 57 is hydraulically slowed as piston 57 enters restriction 63. This prevents first seal assembly 28 from being subjected to impact damage from piston 57.

Referring to FIG. 1, the expansion chamber 44 is provided with a bleed valve 50 that is used to relieve pressure residual pressure in expansion chamber 44 after the assembly has been removed from the well. It is to be noted that expansion chamber 44 is designed so the volume of burnt gases in expansion chamber 44 will be less than the volume of liquid in fluid chamber 51. This allows for a significant drop in gas pressure within expansion chamber 44 to occur, when hydraulic pressure is released from fluid chamber 51 immediately after operation of the assembly.

As previously described, slips 62 are provided as shown in FIG. 2. Slips 62 are in communication with fluid chamber 51. Slips 62 are forced outwardly by hydraulic pressure within fluid chamber 51. Slips 62 engage the well bore to prevent any unwanted movement of the assembly during the setting operation which might result in improper positioning of sleeve 11. As slips 62 are deployed by pressure. They retract upon release of pressure within fluid chamber 51.

Figure 5:
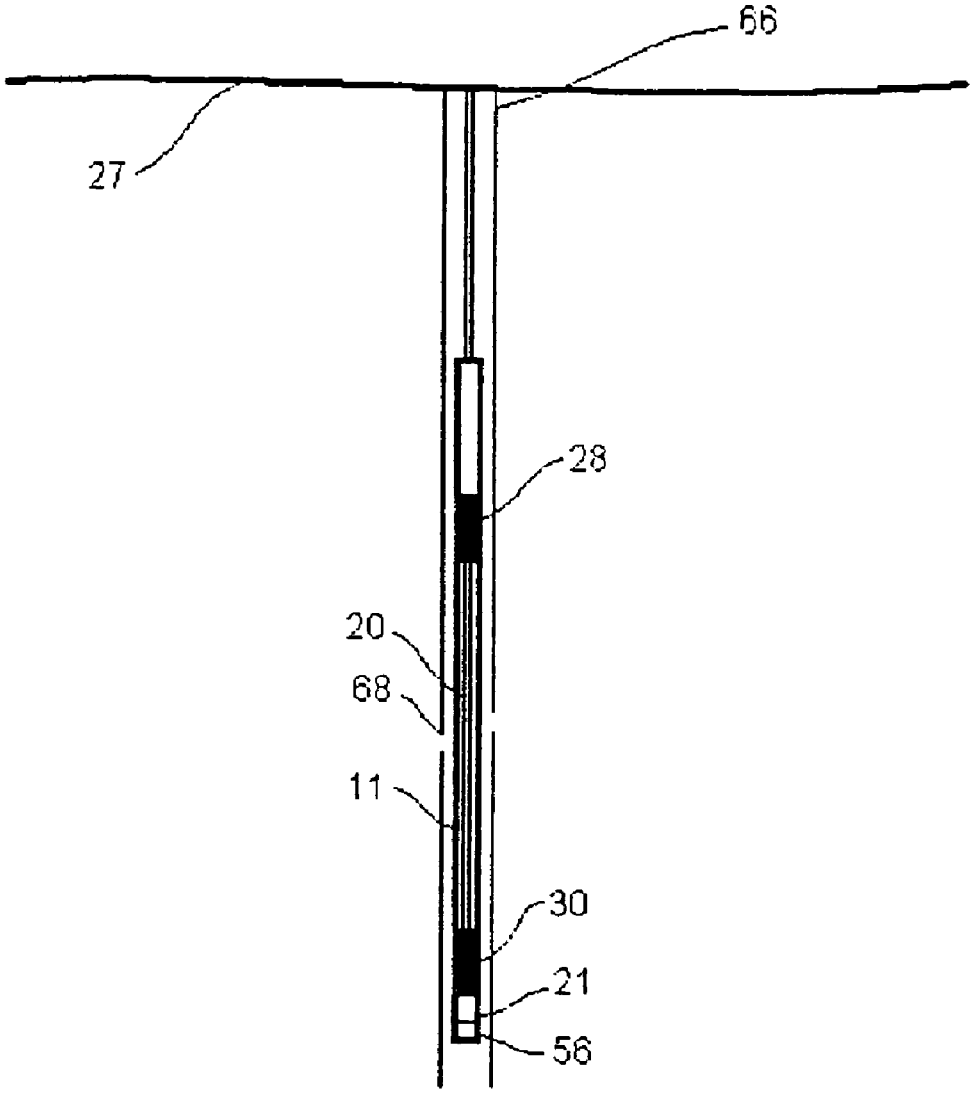
FIG. 5 is a side elevation view, in section, of the assembly for positioning sleeves down hole before the sleeve is expanded.
Figure 6:
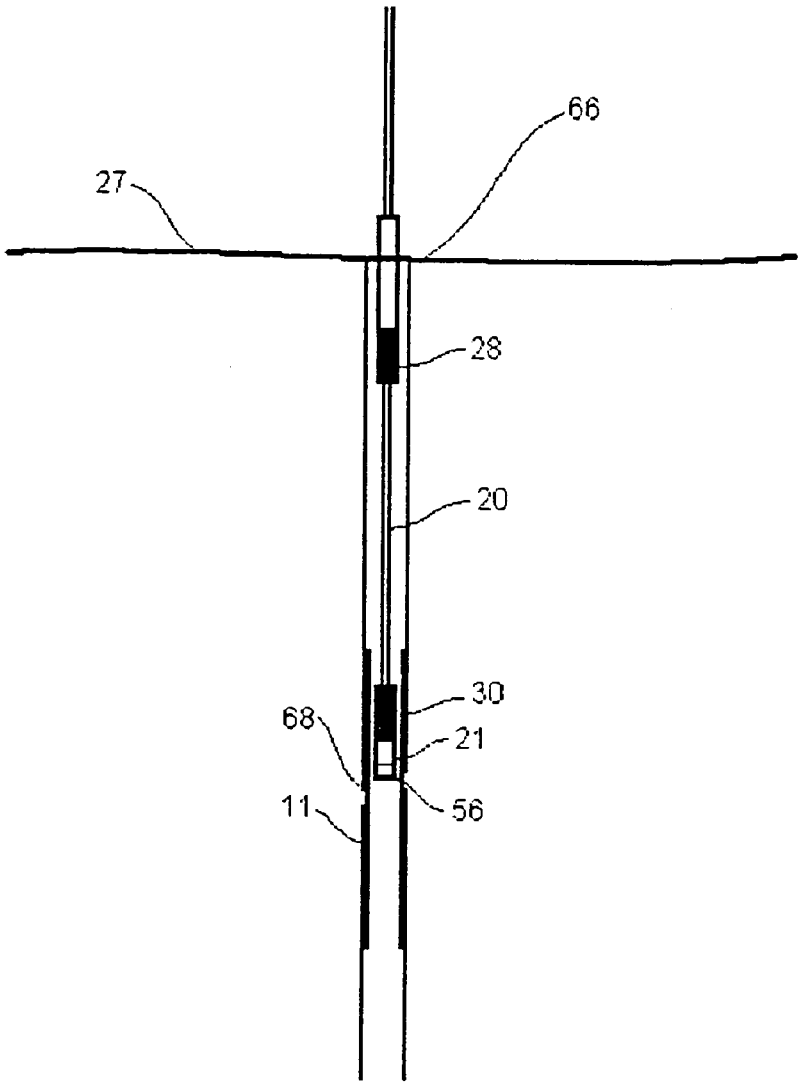
FIG. 6 is a side elevation view, in section, of the assembly for positioning sleeves down hole after the sleeve is expanded.

Operation:

Referring now to FIG. 5, there is a sleeve 11 positioned down hole in a hydrocarbon producing well 66. The running assembly 10 is generally similar to that which is described previously. The assembly 10 is run down the hydrocarbon producing well 66 until the sleeve 11 is positioned as desired within a conduit 68. Sleeve 11 may be positioned to block perforations, or it ma be positioned for another purpose. Once the sleeve 11 is positioned, the electric igniter element 42 ignites the gas generating medium 40 by sending an electrical current from the surface 27 through the electrical conduit 44. Rapidly expanding gases fill the expansion chamber 44 adjacent to the combustion chamber 38. First face 59 of piston 57 is exposed to rapidly expanding gases from expansion chamber 44. The rapidly expanding gases serve as a motive force to move piston 57 from its initial position at first end 53 toward second end 55 of fluid chamber 51. This exerts a hydraulic force upon liquid in fluid chamber 51, which is transmitted through fluid conduit 48 and feed inlet 46 to expand sleeve 11. Slips 62 are forced outwardly by hydraulic pressure within fluid chamber 51. Slips 62 engage the well bore to prevent any unwanted movement of the assembly during the setting operation. The sleeve 11 is expanded by hydraulic pressure until the sleeve 11 engages conduit 68. Pressure is then maintained within the sleeve 11 as the seals 32 of the first seal assembly 28 and the second seal assembly 30 sequentially fail. This expands first end 16 and second end 18 of sleeve 11. When a preset threshold is reached shear screws 22 shear. When shear screws 22 shear, shear sleeve 21 slides down support rod 20. Stopper nut 56 prevents shear sleeve from being lost down the well. Once shear sleeve 21 moves, second seal assembly 30 is free to exit second end 18 of sleeve 11, releasing the pressure and dumping the liquid down the well. The support rod 20 is then pulled through expanded sleeve 11 back to surface 27, as shown in FIG. 6. Expanded sleeve 11 provides sufficient internal clearance that a further sleeve of the same size as the original may, in future, be passed through the expanded sleeve and positioned lower down in the well. This is a significant advantage over other systems, which restrict future access.

The assembly for positioning sleeves may be deployed by, for example, electric wireline, coiled tubing, slickline, tubing, or drill pipe. In addition, while the preferred embodiment has been described using a medium that generates gas under combustion, it will be understood that other methods of providing pressure exist, such as other gas generators, pressure from miniature down hole pumps, or pressure applied from pumps or other sources of pressure on surface down the coiled tubing, tubing or drill pipe.

Variations:

Assembly 10, as described above, was tested dozens of times and was able to successfully expand the sleeve every time. However, when applications were encountered requiring a sleeve made from a thicker gauge of metal, problems were encountered. The thicker gauge of metal required greater pressure to expand it. However, as pressures in excess of 5000 pounds per square inch were reached, seal failure was experienced prior to the shear screws shearing. It was determined that this could be addressed by having the outer diameter of the sealing system adjust as the sleeve expanded. With the original system illustrated and described above, the internal diameter changed, but the outer diameter did not. In order to make a full and complete disclosure, FIGS. 7 through 10 are included in this application which illustrate the seal modifications used to withstand the higher pressures needed to expand sleeves made from thicker gauge of metal. Thicker gauge metal is necessary in applications in which seal grooves are required to accommodate exterior "O" ring seals used to ensure proper exterior sealing of the sleeve.

Figure 7:
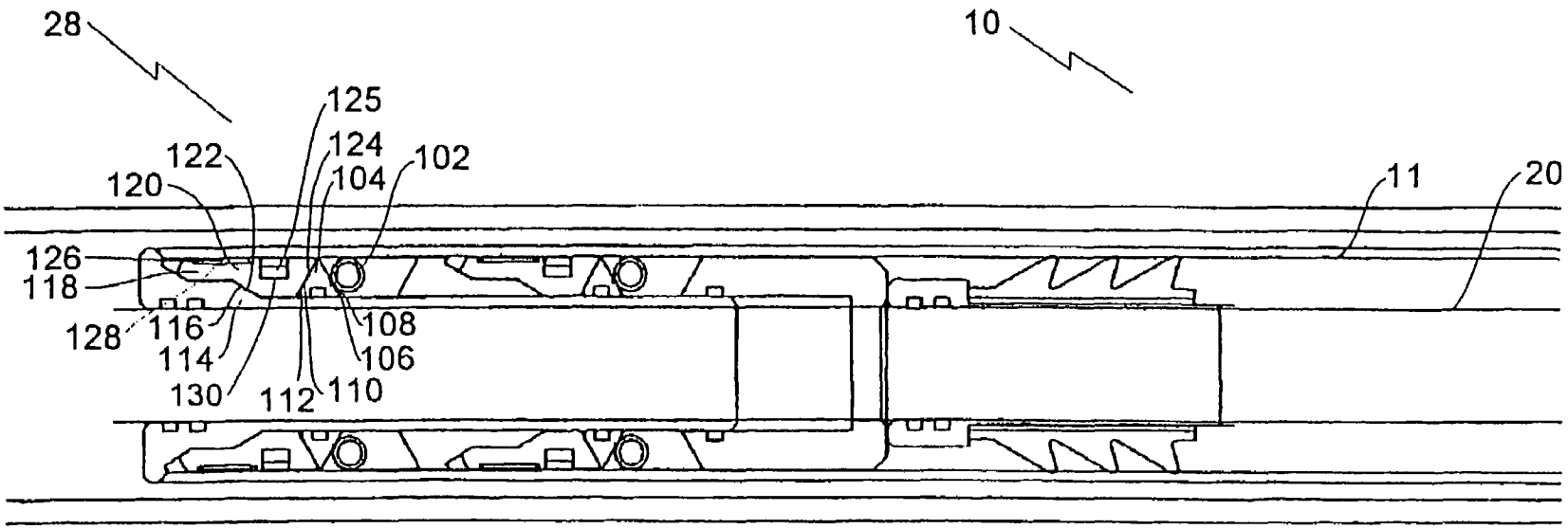
FIG. 7 is a detailed side elevation view, in section, of an alternative sealing assembly for the assembly for positioning sleeves, the sealing system being shown in an unexpanded running position.
Figure 9:
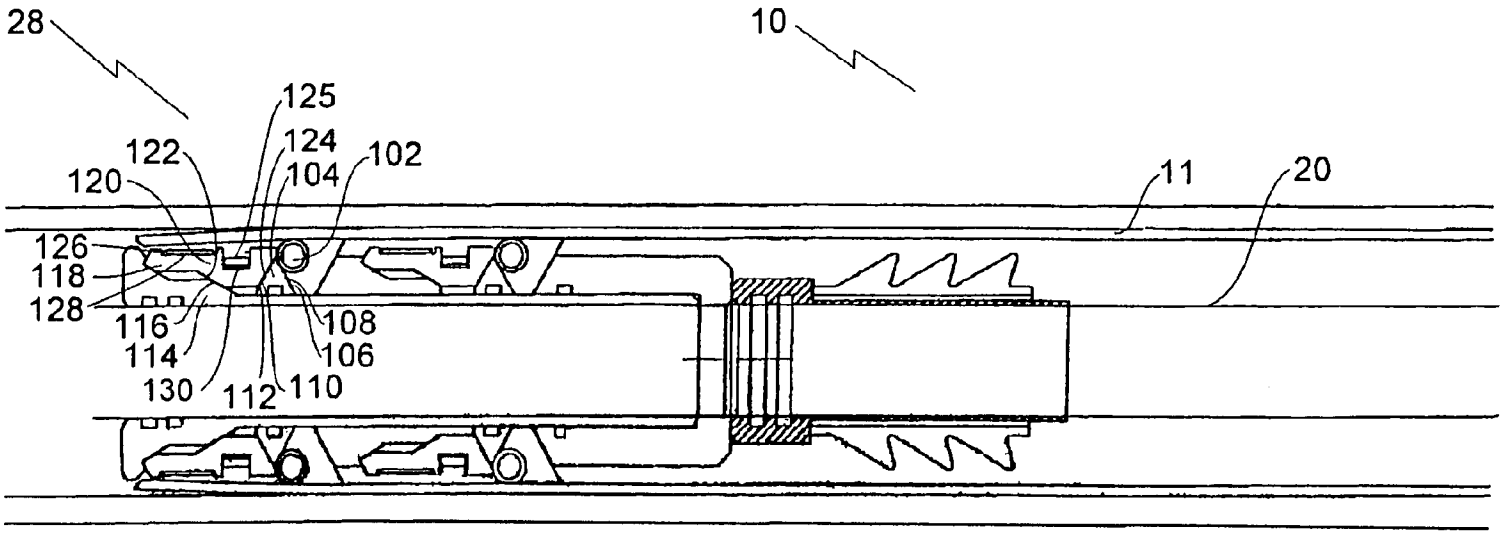
FIG. 9 is a detailed side elevation view, in section, of an alternative sealing assembly illustrated in FIG. 7, shown in an expanded position.
Figure 10:
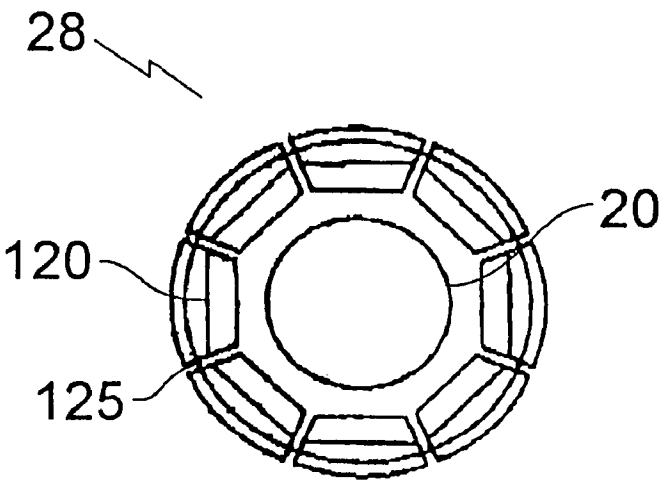
FIG. 10 is an end elevation view, in section, of the alternative sealing assembly illustrated in FIG. 7.

Referring now to FIG. 7, first seal assembly 28 includes an expandable annular primary seal 102 and an annular primary seal activation member 104. Activation member 104 has a primary face 106 with an inclined plane profile 108. Upon activation of assembly 10, an increase in internal pressure directs primary seal 102 up inclined plane profile 108 of primary seal activation member 104. Primary seal 102 expands in circumference as it climbs inclined plane profile 108 and comes into sealing engagement with sleeve 11, as shown in FIG. 9.

Figure 8:
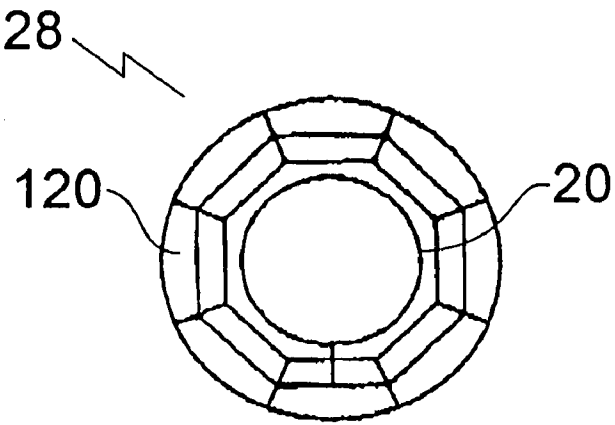
FIG. 8 is an end elevation view, in section, of the alternative sealing assembly illustrated in FIG. 7.

Referring again to FIG. 7, primary seal activation member 104 has a secondary face 110 which is opposed to primary face 106. Secondary face 110 also has an inclined plane profile 112. Primary seal activation member 104 is axially movable along support rod 20 in response to increases in internal pressure upon activation of assembly 10. An annular secondary seal activation member 114 is provided having an inclined plane profile 116. Secondary seal activation member 114 is fixed in position to support rod 20. A secondary seal 118 is positioned between primary seal activation member 104 and secondary seal activation member 114. Referring to FIG. 8, secondary seal 118 has a plurality of sealing segments 120 arranged around the circumference of support rod 20, where, referring again to FIG. 7, each of the sealing segments 120 have an outwardly angled first end 122 and an outwardly angled second end 124. Referring to FIG. 9, upon movement of primary seal activation member 104 along support rod 20 toward secondary seal activation member 114, secondary seal 118 is sandwiched between primary seal activation member 104 and secondary seal activation member 114. Sealing segments 120 are then forced outwardly as outwardly angled first end 122 is forced up inclined plane profile 112 on secondary face 110 of primary seal activation member 104 and outwardly angled second end 124 is forced up inclined plane profile 116 of secondary seal activation member 114. Referring to FIG. 7, an expandable resilient band 125 is located in groove 130 and is used to urge sealing segments 120 of secondary seal 118 from the position shown in FIG. 10 back into engagement with support rod 20 as shown in FIG. 8. Resilient band 125 urges sealing segments 120 by encircling sealing segments 120 of secondary seal 118 and pulling sealing segments 120 back into engagement with the support rod 20. Other means will be apparent to those skilled in the art, for example, springs 126 may also be positioned on an exterior surface 128 of each of the sealing elements 120 around the circumference of secondary seal 118. In this instance, springs 126 push sealing segments 120 of secondary seal 118 back into engagement with support rod 20.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An assembly for positioning a sleeve down hole in a hydrocarbon producing well, comprising:

a sleeve having an interior surface, an exterior surface, a first end, a second end, and seals on the exterior surface of the sleeve, the sleeve being made of a material which is capable of expanding radially when pressure is applied to the interior surface;

a running tool support rod extending axially through the sleeve, the support rod having a first end, a second end, an exterior surface;

a first seal assembly positioned at the first end of the sleeve, the first seal assembly having more than one annular seal, each annular seal engaging the exterior surface of the support rod and the interior surface of sleeve;

a second seal assembly positioned at the second end of the sleeve, the second seal assembly having more than one annular seal, each annular seal engaging the exterior surface of the support rod and the interior surface of sleeve;

a first centralizer positioned at the first end of the sleeve, adapted to centralize the first end of the sleeve;

a second centralizer positioned at the second end of the sleeve, adapted to centralize the second end of the sleeve;

means for preventing an outermost seal of the second seal assembly from exiting the sleeve until the sleeve has been fully expanded and a preset pressure threshold has been reached;

a fluid conduit extending through the support rod to a fluid feed inlet positioned between the first seal assembly and the second seal assembly; and means for selectively sending fluid through the fluid conduit to expand the sleeve by remote activation.

2. The assembly as defined in claim 1, wherein the first centralizer and the second centralizer have circumferentially spaced rollers.

3. The assembly as defined in claim 1, wherein the means for preventing the outermost seal of the second seal assembly from exiting the sleeve until the sleeve has been fully expanded and a preset pressure threshold has been reached is a shear sleeve secured to the support rod by shear screws adapted to shear when the preset pressure threshold is reached.

4. The assembly as defined in claim 1, wherein the means for selectively expanding the sleeve includes means for generating pressure by expansion of gases.

5. The assembly as defined in claim 4, wherein a combustion chamber is provided for the combustion of a gas generating medium, whereby pressure is generated by expansion of gases.

6. The assembly as defined in claim 1, wherein the means for selectively expanding the sleeve includes filling the sleeve with a liquid, and having a fluid chamber filled with liquid in fluid communication with the sleeve, the fluid chamber having a first end and a second end, a piston is provided which has a first face and a second face, the piston being positioned at the first end of the fluid chamber remote from the sleeve, the piston being axially movable in the fluid chamber when a force acts upon the first face of the piston, as the piston moves toward the second end of the fluid chamber the second face of the piston exerts a hydraulic force upon liquid to expand the sleeve.

7. The assembly as defined in claim 6, a restriction being positioned at the second end of the fluid chamber, the movement of the piston being hydraulically slowed as the piston enters the restriction, thereby preventing the first seal assembly being exposed to impact damage from the piston.

8. The assembly as defined in claim 6, wherein an expansion chamber is provided to accommodate rapidly expanding gases and the first face of the piston is exposed to rapidly expanding gases in the expansion chamber, the rapidly expanding gases serving as a motive force to move the piston toward the second end of the fluid chamber.

9. The assembly as defined in claim 5, wherein an electric igniter element is provided in the combustion chamber and an electrical conduit extends from surface to facilitate remotely igniting the gas generating medium by sending an electrical current from surface to the electric igniter element.

10. The assembly as defined in claim 8, wherein a bleed valve is provided to relieve pressure within the expansion chamber.

11. The assembly as defined in claim 1, wherein the first seal assembly and the second seal assembly include at least one inner resilient seal axially spaced from at least one outer high pressure seal.

12. The assembly as defined in claim 1, wherein a stopper nut is positioned on a lower remote end of the support rod below the shear sleeve.

13. The assembly as defined in claim 11, wherein the at least one outer high pressure seal is carried by at least one seal carrier sleeve.

14. The assembly as defined in claim 1, wherein stabilizing slips are provided, the slips being forced outwardly to secure the running tool in the well bore by hydraulic pressure within the fluid chamber.

15. The assembly as defined in claim 1, wherein the first seal assembly includes an expandable annular primary seal and an annular primary seal activation member having a primary face with an inclined plane profile, an increase in internal pressure upon activation of the assembly directing the primary seal up the inclined plane profile of the primary seal activation member, the primary seal expanding in circumference as it climbs the inclined plane profile and comes into sealing engagement with the sleeve.

16. The assembly as defined in claim 15, wherein the primary seal activation member has a secondary face which is opposed to the primary face, the secondary face also having an inclined plane profile, the primary seal activation member being axially movable along the support rod in response to increases in internal pressure upon activation of the assembly, an annular secondary seal activation member being provided having an inclined plane profile, the secondary seal activation member being fixed in position to the support rod, a secondary seal being positioned between the primary seal activation member and the secondary seal activation member, the secondary seal having a plurality of sealing segments arranged around the circumference of the support rod, each of the sealing segments having an outwardly angled first end and an outwardly angled second end, upon movement of the primary seal activation member along the support rod toward the secondary seal activation member, the secondary seal being sandwiched between the primary seal activation member and the secondary seal activation member with the sealing segments being forced outwardly as the outwardly angled first end is forced up the inclined plane profile on the secondary face of the primary seal activation member and of the outwardly angled second end is forced up the inclined plane profile of the secondary seal activation member, means being provided to urge the sealing segments of the secondary seal back into engagement with the support rod.

17. The seal assembly as defined in claim 16, wherein an expandable resilient band encircles the sealing segments of the secondary seal and pulls the sealing segments back into engagement with the support rod.

18. The seal assembly as defined in claim 16, wherein springs are positioned on an exterior surface of each of the sealing elements around the circumference of the secondary seal, the springs pushing the sealing segments of the secondary seal back into engagement with the support rod.

19. An assembly for positioning a sleeve down hole in a hydrocarbon producing well, comprising:

a sleeve having an interior surface, an exterior surface, a first end and a second end, and seals on the exterior surface of the sleeve, the sleeve being made of a material which is capable of expanding radially when pressure is applied to the interior surface;

a running tool including a running tool support rod extending axially through the sleeve, the support rod having a first end, a second end, and an exterior surface;

a first seal assembly positioned at the first end of the sleeve, the first seal assembly having more than one annular seal, each annular seal engaging the exterior surface of the support rod and the interior surface of sleeve;

a second seal assembly positioned at the second end of the sleeve, the second seal assembly having more than one annular seal, each annular seal engaging the exterior surface of the support rod and the interior surface of sleeve;

a first centralizer positioned at the first end of the sleeve, adapted to centralize the first end of the sleeve;

a second centralizer positioned at the second end of the sleeve, adapted to centralize the second end of the sleeve;

a shear sleeve is secured to the support rod by shear screws, preventing an outermost seal of the second seal assembly from exiting the sleeve until the sleeve has been fully expanded, the shear screws being adapted to shear when a preset pressure threshold is reached;

a combustion chamber for the combustion of a gas generating medium;

an electric igniter element in the combustion chamber and an electrical conduit extends from surface to facilitate remotely igniting the gas generating medium by sending an electrical current from surface to the electric igniter element;

an expansion chamber is provided adjacent to the combustion chamber, to accommodate rapidly expanding gases generated by the combustion of the gas generating medium in the combustion chamber;

a fluid chamber filled with liquid in fluid communication with the sleeve which is also filled with liquid, the fluid chamber having a first end and a second end;

a fluid conduit extending axially through the support rod from the second end of the fluid chamber to a feed inlet positioned between the first seal assembly and the second seal assembly;

a piston having a first face and a second face, the piston being positioned at the first end of the fluid chamber remote from the sleeve, the piston being axially movable in the fluid chamber when a force acts upon the first face of the piston, the first face of the piston being exposed to rapidly expanding gases in the expansion chamber, the rapidly expanding gases serving as a motive force to move the piston toward the second end of the fluid chamber, thereby exerting a hydraulic force upon liquid to expand the sleeve.

20. The assembly as defined in claim 19, a restriction being positioned at the second end of the fluid chamber, the movement of the piston being hydraulically slowed as the piston enters the restriction, thereby preventing the first seal assembly being exposed to impact damage from the piston.

21. The assembly as defined in claim 19, wherein the first centralizer and the second centralizer have circumferentially spaced rollers.

22. The assembly as defined in claim 19, wherein a bleed valve is provided to relieve pressure exerted within the expansion chamber.

23. The assembly as defined in claim 19, wherein the first seal assembly and the second seal assembly include at least one inner resilient seal axially spaced from at least one outer high pressure seal.

24. The assembly as defined in claim 19, wherein a stopper nut is positioned on a lower remote end of the support rod below the shear sleeve.

25. The assembly as defined in claim 23, wherein the at least one outer high pressure seal is carried by at least one seal carrier sleeve.

26. The assembly as defined in claim 19, wherein stabilizing slips are provided, the slips being forced outwardly to secure the running tool in the well bore by hydraulic pressure within the fluid chamber, during the setting operation, the slips releasing and disengaging when pressure is relieved upon the shear screws failing.

27. The assembly as defined in claim 19, wherein circumferential seals are provided on the exterior surface of the sleeve.

28. A method for positioning sleeve down hole in a hydrocarbon producing well, comprising the steps of:

running a running assembly with associated sleeve down a hydrocarbon producing well until the sleeve is in a desired positioned in a conduit, the running assembly including a first seal assembly sealing a first end of the sleeve and a second seal assembly sealing a second end of the sleeve, the first seal assembly and the second seal assembly having seals adapted to sequentially fail to expand the first end and the second end of the sleeve and to permit the second seal assembly to exit the second end of the sleeve and release the pressure when a preset threshold is reached;

expanding the sleeve until the sleeve sealingly engages the conduit;

maintaining pressure within the sleeve as the seals of the first seal assembly and the second seal assembly sequentially fail to expand the first end and the second end of the sleeve and until the preset threshold is reached, at which threshold pressure the second seal assembly exits the second end of the sleeve to relieve the pressure; and pulling the running assembly back through the expanded sleeve to surface, the expanded sleeve providing sufficient internal clearance that a further sleeve of the same size as the original may, in future, be passed through the expanded sleeve and positioned lower down in the well.

29. A method for positioning sleeve down hole in a hydrocarbon producing well, comprising the steps of:

providing a running assembly which includes:

a sleeve having an interior surface, an exterior surface, a first end and a second end, and seals on the exterior surface of the sleeve, the sleeve being made of a material which is capable of expanding radially when pressure is applied to the interior surface;

a running tool support rod extending axially through the sleeve, the support rod having a first end, a second end, and an exterior surface;

a first seal assembly positioned at the first end of the sleeve, the first seal assembly having more than one annular seal, each annular seal engaging the exterior surface of the support rod and the interior surface of sleeve;

a second seal assembly positioned at the second end of the sleeve, the second seal assembly having more than one annular seal, each annular seal engaging the exterior surface of the support rod and the interior surface of sleeve;

a first centralizer positioned at the first end of the sleeve, adapted to centralize the first end of the sleeve;

a second centralizer positioned at the second end of the sleeve, adapted to centralize the second end of the sleeve;

means for preventing outermost seals of the more than one seals of each of the first seal assembly and the second seal assembly from exiting the sleeve until the sleeve has been fully expanded and a preset pressure threshold has been reached;

a fluid conduit extending through the support rod to a fluid feed inlet positioned between the first seal assembly and the second seal assembly; and means for selectively sending fluid through the fluid conduit to expand the sleeve by remote activation;

running the assembly down a hydrocarbon producing well until the sleeve is positioned within a conduit;

expanding the sleeve until the sleeve sealingly engages the conduit;

maintaining pressure within the sleeve as the seals of the first seal assembly and the second seal assembly sequentially fail to expand the first end and the second end of the sleeve and until a preset threshold is reached, at which threshold pressure the second seal assembly exits the second end of the sleeve;

pulling the support rod back through the expanded sleeve and back to surface, the expanded sleeve providing sufficient internal clearance that a further sleeve of the same size as the original may in future be passed through the expanded sleeve and positioned lower down in the well.

30. The method as defined in claim 29, a shear sleeve being secured to the support rod by shear screws to prevent an outermost seal of the more than one seals of the second seal assembly from exiting the sleeve until the sleeve has been fully expanded, the shear screws being adapted to shear when a preset pressure threshold is reached.

31. The method as defined in claim 29, a combustion chamber being provided for the combustion of a gas generating medium;

an electric igniter element being provided in the combustion chamber and an electrical conduit extending from surface to facilitate remotely igniting the gas generating medium by sending an electrical current from surface to the electric igniter element;

an expansion chamber being provided adjacent to the combustion chamber, to accommodate rapidly expanding gases generated by the combustion of the gas generating medium in the combustion chamber;

a fluid chamber filled with liquid being in fluid communication with the sleeve which is also filled with liquid, the fluid chamber having a first end and a second end;

a fluid conduit extending axially through the support rod from the second end of the fluid chamber to a feed inlet positioned between the first seal assembly and the second seal assembly;

a piston having a first face and a second face, the piston being positioned at the first end of the fluid chamber remote from the sleeve, the piston being axially movable in the fluid chamber when a force acts upon the first face of the piston, the first face of the piston being exposed to rapidly expanding gases in the expansion chamber, the rapidly expanding gases serving as a motive force to move the piston toward the second end of the fluid chamber, thereby exerting a hydraulic force upon liquid to expand the sleeve.

* * * * *

UNITED STATES PATENT AND TRADEMARK OFFICE

CERTIFICATE OF CORRECTION

PATENT NO. : 7,128,162 B2
APPLICATION NO. : 10/811419
DATED : October 31, 2006
INVENTOR(S) : D. Quinn It is certified that error appears in the above-identified patent and that said Letters Patent is hereby corrected as shown below:

| COLUMN | LINE | ERROR |
|---|---|---|
| Title Page Item (60) Pg. 1, col. 1 | Foreign Appln. Priority Data | insert in appropriate order --(60) **Foreign Application Priority Data** Feb. 2, 2004 (CA) 2509414-- |
| Title Page Item (56) Pg. 1, col. 2 | Refs. Cited (Other Publs., Item 4) | "issue" should read --issued-- |
| Title Page Item (57) Pg. 1, col. 2 | Abstract 1 of text | "for positioning sleeve" should read --for positioning a sleeve-- |
| Title Page Item (57) Pg. 1, col. 2 | Abstract 4 of text | "a desired positioned" should read --a desired position-- |
| Title Page Item (57) Pg. 1, col. 2 | Abstract 6 of text | "seals of holding the" should read --seals holding the-- |
| Title Page Item (57) Pg. 1, col. 2 | Abstract 10 of text | "sleeve to surface." should read --sleeve to the surface.-- |
| 7 (Claim 1, line 15) | 57 | before "sleeve;" insert --the-- |
| 7 (Claim 1, line 20) | 62 | before "sleeve;" insert --the-- |
| 8 (Claim 9, line 3) | 52 | before "surface" insert --the-- |
| 8 (Claim 9, line 5) | 54 | before "surface" insert --the-- |

UNITED STATES PATENT AND TRADEMARK OFFICE

CERTIFICATE OF CORRECTION

PATENT NO. : 7,128,162 B2
APPLICATION NO. : 10/811419
DATED : October 31, 2006
INVENTOR(S) : D. Quinn It is certified that error appears in the above-identified patent and that said Letters Patent is hereby corrected as shown below:

| COLUMN | LINE | ERROR |
|---|---|---|
| 9 (Claim 19, line 15) | 65 | before "sleeve;" insert --the-- |
| 10 (Claim 19, line 20) | 3 | before "sleeve;" insert --the-- |
| 10 (Claim 19, line 34) | 17 | before "surface" insert --the-- |
| 10 (Claim 19, line 36) | 19 | before "surface" insert --the-- |
| 10 (Claim 20, line 5) | 47 | "assembly being" should read --assembly from being-- |
| 11 (Claim 28, line 1) | 6 | before "sleeve" insert --a-- |
| 11 (Claim 28, line 5) | 10 | "desired positioned" should read --desired position-- |
| 11 (Claim 28, line 24) | 29 | before "surface," insert --the-- |
| 11 (Claim 29, line 1) | 34 | before "sleeve" insert --a-- |
| 11 (Claim 29, line 16) | 49 | before "sleeve;" insert --the-- |
| 11 (Claim 29, line 21) | 54 | before "sleeve;" insert --the-- |
| 12 (Claim 29, line 49) | 20 | before "surface," insert --the-- |

UNITED STATES PATENT AND TRADEMARK OFFICE

CERTIFICATE OF CORRECTION

PATENT NO. : 7,128,162 B2
APPLICATION NO. : 10/811419
DATED : October 31, 2006
INVENTOR(S) : D. Quinn It is certified that error appears in the above-identified patent and that said Letters Patent is hereby corrected as shown below:

| COLUMN | LINE | ERROR |
|---|---|---|
| 12 (Claim 31, line 5) | 35 | before "surface" insert --the-- |
| 12 (Claim 31, line 7) | 37 | before "surface" insert --the-- |

Signed and Sealed this

Twenty-seventh Day of March, 2007

JON W. DUDAS
*Director of the United States Patent and Trademark Office*